US006213803B1

(12) United States Patent
Kato et al.

(10) Patent No.: US 6,213,803 B1
(45) Date of Patent: Apr. 10, 2001

(54) IC SOCKET

(75) Inventors: Yuji Kato, Yokohama; Nanahiro Hayakawa, Tokyo, both of (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/240,684

(22) Filed: Feb. 2, 1999

(30) Foreign Application Priority Data

Feb. 2, 1998 (JP) ..... 10-020932

(51) Int. Cl.[7] ..... H01R 11/22
(52) U.S. Cl. ..... 439/266
(58) Field of Search ..... 439/70–73, 263–266, 439/268, 330, 331

(56) References Cited

U.S. PATENT DOCUMENTS

| | | | |
|---|---|---|---|
| 3,805,212 | | 4/1974 | Landman et al. . |
| 4,189,199 | | 2/1980 | Grau . |
| 4,222,622 | | 9/1980 | Griffin et al. . |
| 4,491,377 | | 1/1985 | Pfaff . |
| 4,533,192 | | 8/1985 | Kelley . |
| 4,623,208 | | 11/1986 | Kerul et al. . |
| 4,691,975 | | 9/1987 | Fukunaga et al. . |
| 5,713,751 | * | 2/1998 | Fukunaga ..... 439/266 |
| 5,800,193 | * | 9/1998 | Tsubakihara et al. ..... 439/266 |

FOREIGN PATENT DOCUMENTS

| | | |
|---|---|---|
| 24 31 815 | 1/1975 | (DE) . |
| 2 039 160 | 7/1980 | (GB) . |
| 50-94490 | 8/1975 | (JP) . |
| 53-43876 | 4/1978 | (JP) . |
| 56-45581 | 4/1981 | (JP) . |
| 60-81654 | 6/1985 | (JP) . |
| 3-24035 | 4/1991 | (JP) . |
| 9-115628 | 5/1997 | (JP) . |
| 9-266045 | 10/1997 | (JP) . |
| 10-50441 | 2/1998 | (JP) . |
| 10-144436 | 5/1998 | (JP) . |

* cited by examiner

*Primary Examiner*—Khiem Nguyen
(74) *Attorney, Agent, or Firm*—Wenderoth, Lind & Ponack, L.L.P.

(57) ABSTRACT

This invention pertains to an IC socket including a plurality of contacts arranged in such a manner as to be able to contact an external contact point of an IC package. The contacts each include a pressure applying arm for exerting a downward force to the external contact point while being in contact, under pressure with the external contact point, and a pressure receiving arm having a load receiving portion for receiving the external contact point while being in contact, under pressure with the external contact point against a pressing. The pressure receiving arm is, the pressure receiving arm being provided on the load receiving portion with a downward movement preventive portion engageable with a socket body to set a loading level of the load receiving portion, wherein the downward movement preventive portion is formed by a downwardly facing surface of the load receiving portion. The load receiving portion is pulled up against an elastic force of the pressure receiving arm such that the downwardly facing surface is in elastic engagement with an upwardly facing surface of the socket body, and a connecting portion between the pressure receiving arm and the load receiving portion is provided with a forward movement preventive portion capable of elastically engaging with the socket body to restrict the forward movement of the load receiving portion.

23 Claims, 6 Drawing Sheets

IC SOCKET

BACKGROUND OF THE INVENTION

1. Field of the Invention

This invention relates to an IC socket having a single contact capable of contacting an external contact point of an IC package, which single contact includes a pressure applying arm and a pressure receiving arm such that the external contact point is brought into contact, under pressure, with the pressure receiving arm by the pressing force of the pressure applying arm.

2. Related Art

In an IC socket discussed in Japanese Patent Publication No. Hei 3-24035, a contact includes a pair of pinchingly holding pieces raised in parallel relation from a basal portion thereof, each pinchingly holding piece being elastically displaced forwardly and backwardly through a spring specific to each pinchingly holding piece. This pinchingly holding piece pair pinchingly holds an upper and a lower surface of an external contact point of an IC package, thereby constituting an IC socket of a two-point contact structure. The front side opposing pinchingly holding piece is in position for storing an elastic force in an opposing direction and in abutment with a lower surface of the external contact point, while the rear side pinchingly holding piece is elastically displaced forwardly and backwardly by upward and downward movement of a contact opening/closing member (releasing member) such that when displaced forwardly, the rear side pinchingly holding piece is brought into contact, under pressure, with an upper surface of the IC external contact point, thereby forming the two-point contact structure together with the front side pinchingly holding piece.

However, the above conventional IC socket has such shortcomings that the level of the contact surface of the front side pinchingly holding piece with respect to a lower surface of the external contact point of the IC package is not constant, thereby making it unable to provide a stable contact relation with the external contact point, with a result that the external contact point will be deformed by a pressing pressure of the rear side pinchingly holding piece.

The present invention has been accomplished in view of the above problems inherent in the conventional IC packages.

SUMMARY OF THE INVENTION

It is, therefore, an object of the present invention to provide an IC package in which a reliable contact relation with an external contact point of an IC package is ensured.

A specific object of the present invention is to provide an IC package capable of providing a constant contacting level with an external contact point of an IC package.

A further object of the present invention is to provide an IC package in which an external contact point of an IC package is prevented from being deformed.

In order to achieve the above objects, from one aspect of the present invention, there is essentially provided an IC socket including a plurality of contacts arranged in such a manner as to be able to contact an external contact point of an IC package. The contacts each including a pressure applying arm for exerting a downward force to the external contact point while being in contact, under pressure with the external contact point, and a pressure receiving arm having a load receiving portion for receiving the external contact point while being in contact, under pressure with the external contact point against a pressing force of the pressure applying arm, the pressure receiving arm is provided on the load receiving portion with a downward movement preventive portion engageable with a socket body to set a loading level of the load receiving portion, wherein the downward movement preventive portion is formed by a downwardly facing surface of the load receiving portion. The load receiving portion is pulled up against an elastic force of the pressure receiving arm such that the downwardly facing surface is in elastic engagement with an upwardly facing surface of the socket body, and a connecting portion between the pressure receiving arm and the load receiving portion is provided with a forward movement preventive portion capable of elastically engaging with the socket body to restrict the forward movement of the load receiving portion.

From another aspect of the present invention, there is also provided an IC socket including a plurality of contacts arranged in such a manner as to be able to contact an external contact point of an IC package. The contacts each include a pressure applying arm for exerting a downward force to the external contact point while being in contact, under pressure with the external contact point, and a pressure receiving arm having a load receiving portion for receiving the external contact point while being in contact, under pressure with the external contact point against a pressing force of the pressure applying arm. The pressure receiving arms being provided on the load receiving portion with a downward movement preventive portion engageable with a socket body to set a loading level of the load receiving. portion, wherein the load receiving portion is moved downwardly, by pressure from the pressure applying arm, to bring the downward movement preventive portion into engagement with the socket body, and a connecting portion between the pressure receiving arm and the load receiving portion is provided with a forward movement preventive portion capable of elastically engaging with the socket body to restrict the forward movement of the load receiving portion.

From a further aspect of the present invention, there is also provided an IC socket including a plurality of contacts arranged in such a manner as to be able to contact an external contact point of an IC package. The contacts each include a pressure applying arm for exerting a downward force to the external contact point while being in contact, under pressure with the external contact point, and a pressure receiving ann having a load receiving portion for receiving the external contact point while being in contact, under pressure with the external contact point against a pressing force of the pressure applying arm. The pressure receiving arm being provided on the load receiving portion with a downward movement preventive portion engageable with a socket body to set a loading level of the load receiving portion, wherein the downward movement preventive portion being formed by a downwardly facing surface of the load receiving portion. The load receiving portion is pulled up against an elastic force of the pressure receiving arm such that the downwardly facing surface is in elastic engagement with an upwardly facing surface of the socket body, and a connecting portion between the pressure receiving arm and the load receiving portion is provided with a forward movement preventive portion capable of elastically engaging with the socket body to restrict the forward movement of the load receiving portion.

From a still further aspect of the present invention, there is also provided an IC socket including a plurality of contacts arranged in such a manner as to be able to contact an external contact point of an IC package. The contacts each include a pressure applying arm for exerting a downward force to the external contact point while being in contact, under pressure with the external contact point, and a pressure receiving arm having a load receiving portion for receiving the external contact point while being in contact, under pressure with the external contact point against a pressing force of the pressure applying arm. The pressure receiving arm is provided on the load receiving portion with a downward movement preventive portion engageable with a socket body to set a loading level of the load receiving portion. The load receiving portion is moved downwardly, by pressure from the pressure applying arm, to bring the downward movement preventive portion into engagement with the socket body, and a connecting portion between the pressure receiving arm and the load receiving portion is provided with a forward movement preventive portion capable of elastically engaging with the socket body to restrict the forward movement of the load receiving portion.

The load receiving portion may be provided with a backward movement preventive portion capable of engagement with the socket body to restrict the backward movement of the load receiving portion.

A more complete application of the present invention and many of the attendant advantages thereof will be readily apparent as the same becomes better understood by reference to the following detailed description when considered in connection with the accompanying drawings.

DETAILED DESCRIPTION OF THE EMBODIMENT

One embodiment of the present invention will now be described with reference to FIGS. 1 to 8 of the accompanying drawings.

Figure 1:
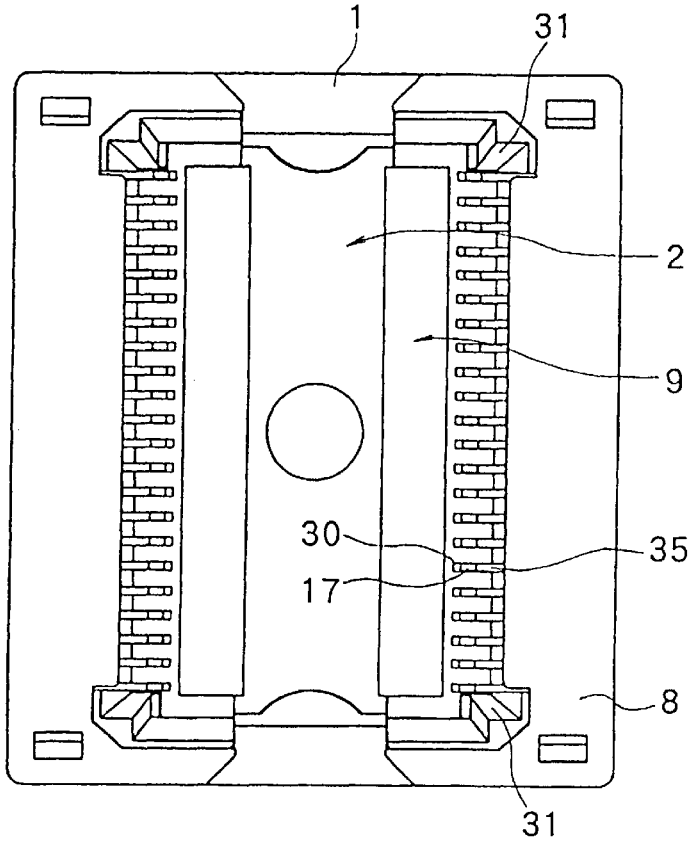
FIG. 1 is a plan view of an IC socket according to one embodiment of the present invention.
Figure 2:
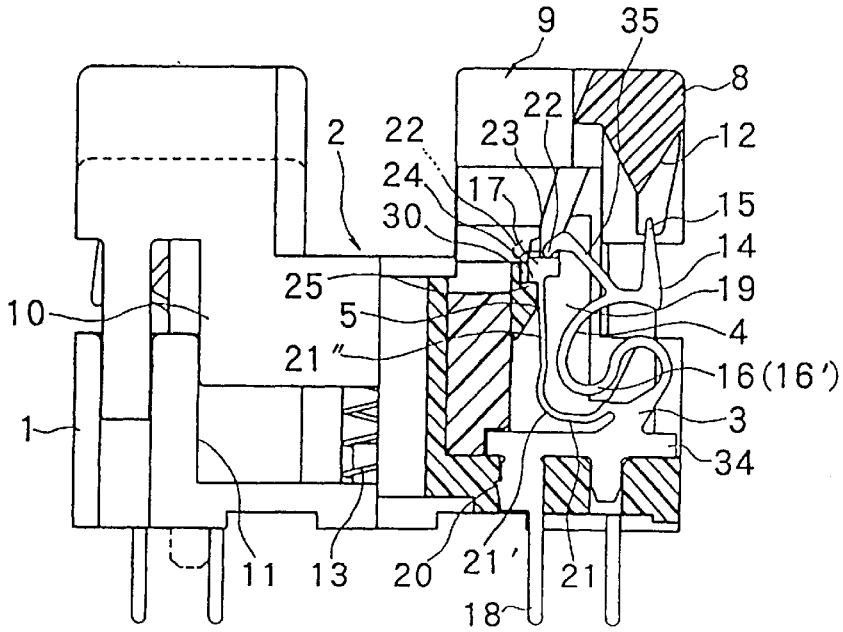
FIG. 2 is a side view, partly in section, of the IC socket of FIG. 1, showing a contact of the IC socket displaced forwardly.

As shown in both FIGS. 1 and 2, as well as elsewhere, a socket body 1 made of insulative material has an IC receiving portion 2 in a central portion of its upper surface, and a plurality of contacts 3 arranged an array along two or four opposing sides of the IC receiving portion 2. Each of the contacts 3 has a pressure applying arm 4 disposed backwardly and a pressure receiving arm 5 disposed forwardly.

The pressure applying arm 4 is capable of being elastically displaced forwardly and backwardly. As shown in FIG. 4, when being displaced forwardly, the pressure applying arm 4 is brought into contact, under pressure, with an external contact point 7 of an IC package 6 to exert a downward force thereto so that the external contact point 7 is pressed against a load receiving portion 17 of the pressure receiving arm 19.

In other words, the load receiving portion 17 of the pressure receiving arm 5 receives the external contact point 7 while being in contact, under pressure, with the external contact point 7 against the pressing force of the pressure applying arm 4. The downward force exerted to the external contact point 7 from the pressure applying arm 4 is removed by elastically displacing the pressure applying arm 4 backwardly.

As a means for displacing the pressure applying arm 4 forwardly and backwardly, there is provided a contact opening/closing member 8 disposed on an upper portion of the socket body 1. This contact opening/closing member 8 exhibits a frame-like configuration and has a central opening 9 opposing the IC receiving portion 2 from above. The IC package 6 is received in the IC receiving portion 2 through this central opening 9 for electrical connection.

For guiding the upward and downward movement, a vertical guide portion 10 of the contact opening/closing member 8 is slip fitted in a vertical guide portion 11 disposed on an outer surface of the socket body 1.

A frame wall of the contact opening/closing member 8 is provided with a cam portion 12 for opening/closing the contact 3, which contact opening/closing member 8 is disposed in such a manner as to correspond to the array of the contacts 3. By a downward operation of the opening/closing member 8, the cam portion 12 is caused to act on the pressure applying arms 4 such that the pressure applying arms 4 are elastically displaced backwardly for each array to form a contact releasing relation with the external contact point 7. The pressure applying arms 4 are elastically displaced forwardly when the opening/closing member 8 is move upwardly, to thereby form a pressure contact relationship with the external contact point 7.

The contact opening/closing member 8 is moved upwardly by an upwardly biasing return spring 13 or by a forwardly displacing force generated when the pressure applying arm 4 is displaced forwardly by its restoring force.

As means for causing the cam portion 12 provided on the contact opening/closing member 8 to act on the pressure applying arm 4, a control arm 14 is integrally punched out backwardly from an area in the vicinity of an upper end of the pressure applying arm 4, and when the contact opening/closing member 8 is moved downwardly and the cam portion 12 presses a pressure receiving projection 15 projecting upwardly from an end portion of the control arm 14, the pressure receiving projection 15 is turned backwardly by guidance of the cam portion 12, to thereby displace the pressure applying arm 4 in each array backwardly against a resilient force of a first spring portion 16. When the force for pressing the contact opening/closing member 8 is removed, the opening/closing member 8 is moved upwardly through the cam portion 12 while turning the control arm 14 upwardly by a forwardly restoring force of the first spring portion 16 of the pressure applying arm 4, or the opening/closing member 8 is moved upwardly by the restoring force of the spring 13.

The pressure applying arm 4 may be elastically displaced through a motion transmitting lever made of insulative material and adapted to transform a vertical motion of the contact opening/closing member 8 into a forward and backward motion of the pressure applying arm 4.

Instead of providing the contact opening/closing member 8, the pressure applying arm 4 may be elastically displaced forwardly and backwardly by actuating a jig, which is provided on a working end of a robot, on either the pressure receiving projection 15 of the pressure applying arm 4 or the pressure receiving portion of the motion transmitting lever.

Figure 5:
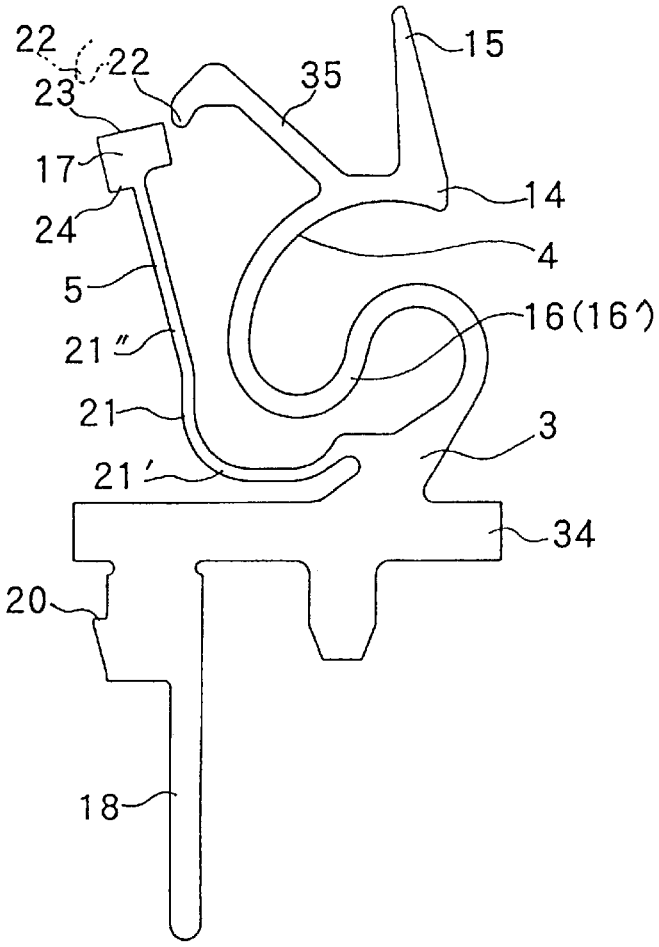
FIG. 5 is a side view of the contact.

As shown in FIG. 5, as well as elsewhere, the contact 3 includes a rigid basal portion 34 extending forwardly and backwardly. The pressure applying arm 4 and the pressure receiving arm 5 extend upwardly from the basal portion 34. A male terminal 18 extends downwardly from the basal portion 34.

The basal portion 34 sits on an inner bottom surface of a contact receiving groove 19 formed in the socket body 1. The basal portion includes a main portion and a secondary portion extending from the main portion. The contact 3 is implanted in the socket body I with the male terminal 18 press fitted to the groove bottom wall in such a manner as to extend downwardly, and with a press-fit claw 20 formed on a press-fit portion of the basal portion of the male terminal 18 bit into an inner wall of a through hole. On the other hand, the pressure applying arm 4 and the pressure receiving arm 5 extend upwardly through the contact receiving groove 19.

The first spring portion 16 of the pressure applying arm 4 is formed by a lateral S-shaped spring portion 16' which includes a front curved portion and a rear curved portion. One end of the lateral S-shaped spring portion 16', i.e., an end portion of the rear curved portion is connected with the basal portion 34 and the other end, i.e., an end portion of the front curved portion is connected with a contact arm 35 at a forwardly inclined angle. The contact arm 35 is provided on a free end thereof with a downwardly facing contact projection 22.

The control arm 14 extends backwardly from the connecting portion between the contact arm 35 and the lateral S-shaped spring portion 16'. The control arm 14 is provided on a free end thereof with the upwardly facing pressure receiving projection 15.

The cam portion 12 of the contact opening/closing member 8 acts on the pressure receiving projection 15 to displace the pressure applying arm 4 backwardly against the resilient force of the lateral S-shaped spring portion 16'.

On the other hand, the pressure receiving arm 5 disposed forwardly of the pressure applying arm 4 includes a second spring portion 21. An upper end of the second spring portion 21 is connected with the load receiving portion 17.

The second spring portion 21 has both the function for elastically displacing the load receiving portion 17 forwardly and the function for elastically displacing the portion 17 upwardly and downwardly. The second spring portion 21 exhibits a spring configuration capable of satisfying those functions.

As shown in FIG. 5, as well as elsewhere, for example, a forwardly projecting curved spring portion 21' is provided on the basal end side and extends laterally from the secondary portion across the main portion. An end portion of this curved spring portion 21' is connected with an upwardly extending spring arm 21", and an end portion of this spring arm 21" is connected with the load receiving portion 17. This load receiving portion 17 has rigidity. With the contact 3 implanted in the socket body 1, an upper portion of the load receiving portion 17 forms a load receiving surface 23 which is inclined at a horizontal angle or close to a horizontal.

Figure 3A:
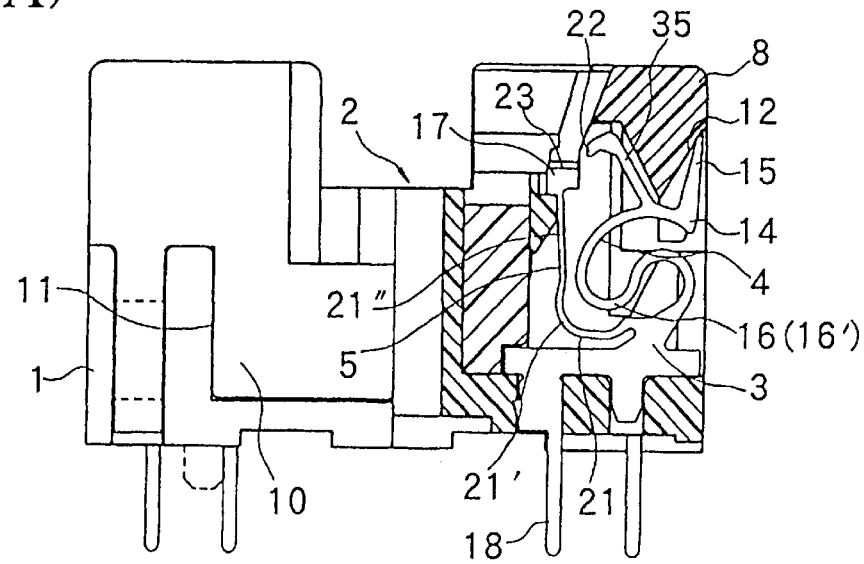
FIG. 3A is a side view, partly in section, of the IC socket, showing the contact displaced backwardly.
Figure 3B:
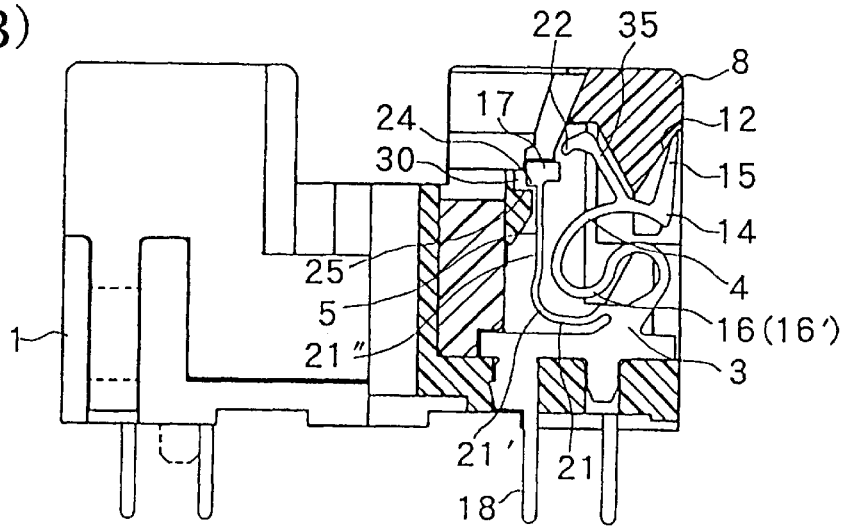
FIG. 3B is an enlarged side view, of the IC socket, showing a load receiving portion of the contact moved away upwardly from a downward movement preventive portion and in a standby position.
Figure 3C:
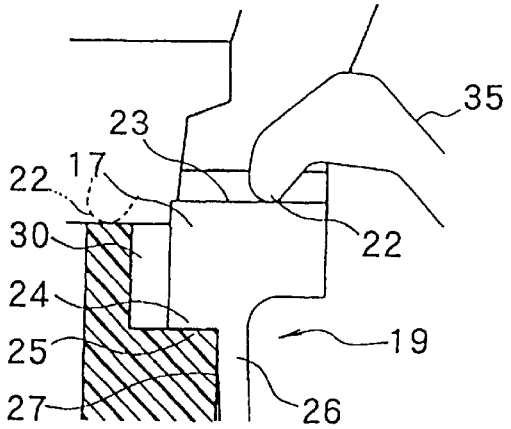
FIG. 3C is an enlarged sectional view of the IC socket, showing the contact of FIGS. 3A and 3B displaced forwardly.

As shown in FIG. 3C, when the IC package 6 is not present, the contact projection 22 of the pressure applying arm 4 is in contact, under pressure, with the load receiving surface 23.

As shown in FIG. 3A, by downward operation of the contact opening/closing member 8, the pressure applying arm 4 is elastically displaced backwardly and at the same time, the contact projection 22 is displaced slantwise backwardly to open the load receiving surface 23. As shown in FIG. 4, when the load receiving surface 23 is in the open position, the IC package 6 is received in the IC receiving portion 2 and the external contact point 7 projecting sidewardly from the IC package body is placed on the load receiving surface 23 of the load receiving portion 17.

The pressure receiving arm 5 is provided on the load receiving portion 17 with a downward movement preventive portion 24 which is capable of engaging with the socket body 1 to set the load receiving level.

As shown in FIGS. 3C, 4B, 7A and 8A, as well as elsewhere, the downward movement preventive portion 24 is normally engaged with a downward movement preventive portion 25 provided on the socket body 1 to thereby maintain the constant load receiving level of the load receiving portion 17, i.e., the constant load receiving level of the load receiving surface 23.

That is, the load receiving portion 17 of the pressure receiving arm 5 is pulled upwardly against the effect of the second spring portion 21 to bring the downward Movement preventive portion 24 into elastic engagement with the downward movement preventive portion 25. Accordingly, when the downward movement preventive portions 24, 25 are in elastic engagement with each other, the second spring portion 21 stores the downward resilient force. By this, the load receiving portion 17 maintains the constant load receiving level with respect to the external contact point 7 of the IC package 6.

As shown in FIGS. 3B, 4C, 7B and 8B, as well as elsewhere, the load receiving portion 17 is brought in a standby position upwardly away from the downward movement preventive portion 25. Then, the load receiving portion 17 is moved downwardly against the pressing force of the pressure applying arm 4 to bring the downward movement preventive portion 24 into engagement with the downward movement preventive portion 25, thereby to maintain the constant load receiving level of the load receiving portion 17 with respect to the external contact point 7.

The downwardly facing surface (downward movement preventive portion 24) of the load receiving portion 17 is brought into elastic engagement with the upwardly facing surface (downward movement preventive portion 25) provided on the socket body 1 against the resilient force of the second spring portion of the pressure receiving arm 5. The downward movement preventive portions 24, 25 are inclined at a horizontal angle or near to a horizontal angle.

The pressure receiving arm 5 can be elastically displaced forwardly and backwardly together with the load receiving portion 17 by the second spring portion 21. The connecting portion between the pressure receiving arm 5 and the load receiving portion 17 may be provided with a forward movement preventive portion 26 which is elastically engaged with the socket body 1 to restrict the forward movement of the load receiving portion 17 when the contact 3 is implanted in the socket body 1.

Figure 6:
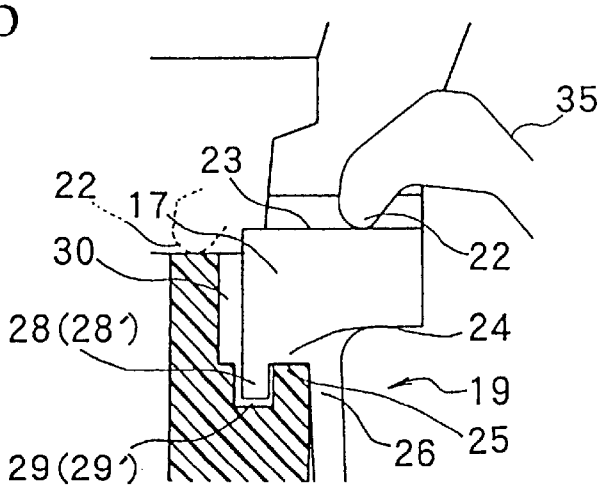
FIG. 6 is an enlarged sectional view of a backward movement preventive portion provided on the load receiving portion of the contact.

As shown in FIG. 6, the load receiving portion 17 may be provided with a backward movement preventive portion 28 which is brought into engagement with the socket body 1 to restrict the backward movement of the load receiving portion 17.

Figure 4A:
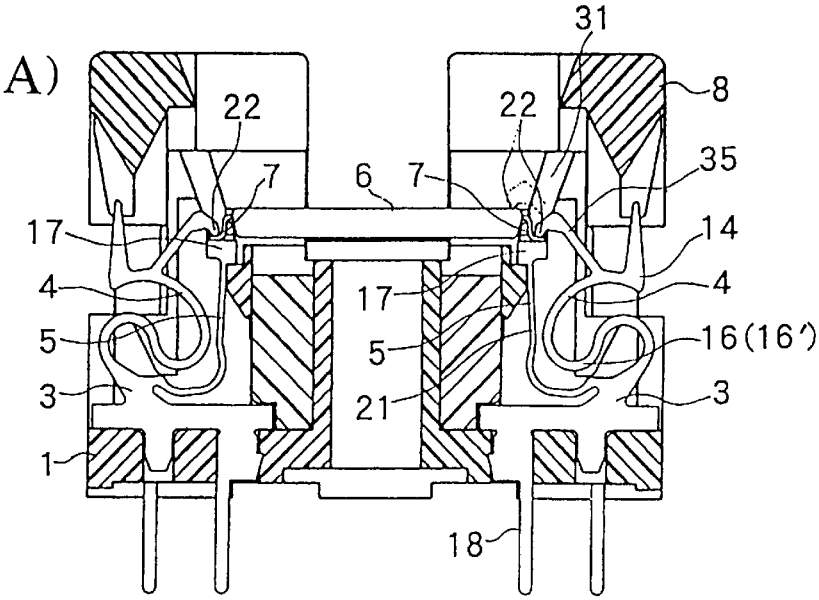
FIG. 4A is a sectional view, showing the contact of the IC socket displaced forwardly and in contact, under pressure, with the external contact point of the IC package.
Figure 4B:
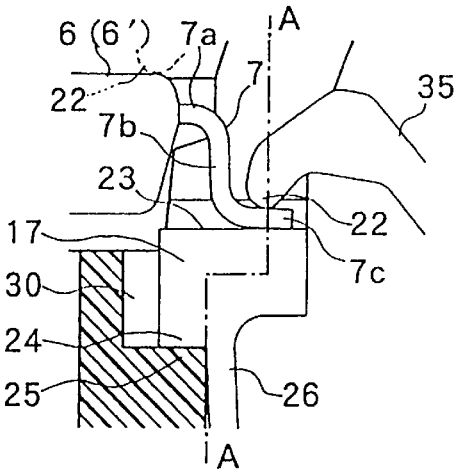
FIG. 4B is an enlarged sectional view of FIG. 4A, showing the contact being in contact, under pressure, with the external contact point of the IC package.

Preferably, as shown in FIGS. 3C and 4B, as well as elsewhere, the forward movement preventive portion 26 restricts the forward movement of the load receiving portion 17 by bringing a front side surface of an upper end portion of the pressure receiving arm located immediately under the load receiving portion 17 into elastic engagement with a forward movement preventive portion 27 provided on the socket body 1.

Instead of the above construction, the forward movement of the load receiving portion 17 can be restricted by bringing the front side surface of the load receiving portion 17 into elastic engagement with the side surface of the socket body 1.

The backward movement preventive portion 28 is formed by an engagement piece 28' projecting downwardly from the downward movement preventive portion 24 formed on, for example, the downwardly facing surface of the load receiving portion 17, and this engagement piece 28' is brought into engagement with an engagement groove 29' formed in the upwardly facing surface Which forms the downward movement preventive portion 25 provided on the socket body 1.

The engagement piece 28' is engaged with an inner surface of the engagement groove 29' to thereby prevent the backward movement of the load receiving portion 17. The engagement groove 29' forms the backward movement preventive portion 28 which restricts the backward movement of the load receiving arm 5 by co-acting with the engagement piece 28'.

Figure 7A:
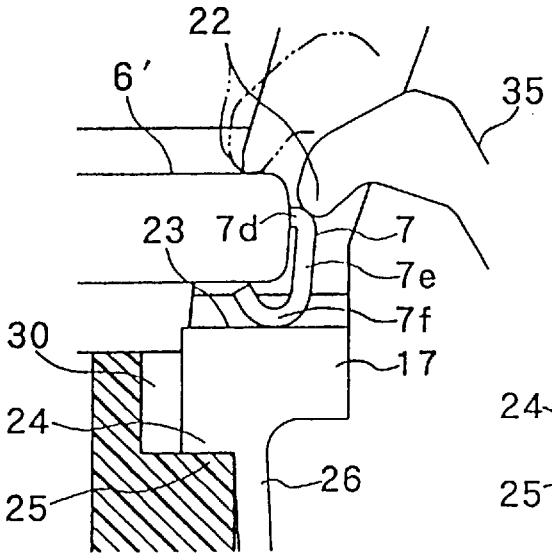
FIG. 7A is an enlarged sectional view, showing the contact of the IC socket being in contact, under pressure, with a J-bent type external contact point of the IC package.

As shown in FIGS. 4A, 4B and 7A, as well as elsewhere, when the pressure applying arm 4 is restored forwardly, the contact projection 22 is brought into contact, under pressure, with the external contact point 7 of the IC package 6 to exert a downward force thereto, so that the external contact point 7 is brought into contact, under pressure, with the load receiving surface 23 of the pressure receiving arm 5 by this downward force.

As shown in FIG. 3C, as well as elsewhere, the contact projection of the pressure applying arm 4 is in a standby position in pressure contact relationship with the load receiving surface 23 and held in a so-called preloaded state. When the external contact point 7 of the IC package 6 is pinchingly held between the contact projection 22 of the pressure applying arm 4 and the load receiving surface 23 of the load receiving portion 17, a resilient force corresponding to the thickness of the external contact point 7 in addition to the preload is applied to the external contact point 7 so that the external contact point 7 is pinchingly held between the pressure applying arm 4 and the pressure receiving arm 5 by this additional resilient force.

The load receiving portion 17 of the pressure receiving arm 5 is received in a receiving groove 30 formed in the socket body 1 and prevented from sideward displacement by a partition wall formed between adjacent receiving grooves 30, so as to be held in a corresponding position to the external contact point 7.

The receiving grooves 30 of the load receiving portion 17 and the receiving grooves 19 of the contact are arranged at mutually same pitches and communicated with each other.

Figure 4C:
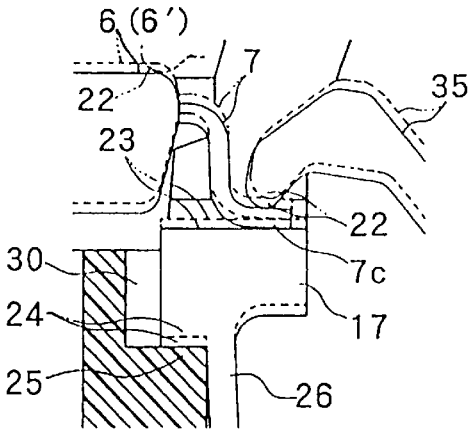
FIG. 4C is an enlarged sectional view of FIG. 4A, showing the contact being in contact, under pressure, with the external contact point of the, IC package when a load receiving portion of the contact is floating upwardly and in a standby position.
Figure 4D:
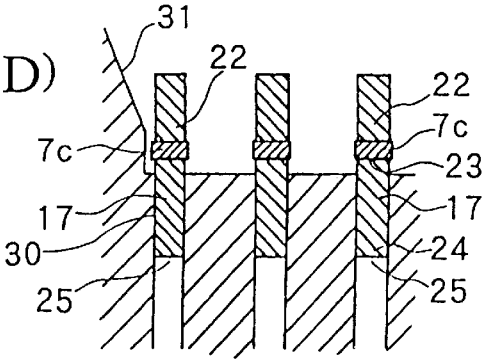
FIG. 4D is an enlarged sectional view of a contact portion between the external contact point of the IC package and the contact, taken on line A—A of FIG. 4B.

As shown in FIG. 4D, as well as elsewhere, the socket body 1 has a slanted surface 31 for guiding an outer surface of the external contact point 7 on the end of the array into a correct placing position when the IC package 6 is received in the IC receiving portion 2.

The slanted surfaces 31 are provided in such a manner as to correspond to the outer surfaces of the external contact points 7 on the opposite ends of each array of the external contact points 7 projecting from each side of the IC package 6. The outer surfaces of the external contact points 7 are slid along the slanted surfaces 31 so that the external contact points 7 are correctly placed on the load receiving surface 23 of the pressure receiving arm 5.

The second embodiment of the present invention will now be described with reference to FIGS. 1 to 3, and 5 to 10.

As shown in FIGS. 1 and 2, as well as elsewhere, the socket body 1 made of insulative material has an IC receiving portion 2 in a central portion of its upper surface, and a plurality of contacts 3 arranged in array along two or four opposing sides of the IC receiving portion 2. Each of the contacts 3 has a pressure applying arm 4 disposed backwardly and a pressure receiving arm 5 disposed forwardly.

The pressure applying arm 4 is capable of being elastically displaced forwardly and backwardly. As shown by broken lines of FIG. 4C and as shown in FIGS. 9B and 10B, when displacing forwardly, the pressure applying arm 4 is brought into contact, under pressure, with an external contact point 7 of an IC package 6 to exert a downward force thereto so that the external contact point 7 is pressed against a load receiving portion 17 of the external contact point 7.

In other words, the load receiving portion 17 of the pressure receiving arm 5 receives the external contact point 7 while being in contact, under pressure, with the external contact point 7 against the pressing force of the pressure applying arm 4. The downward force exerted to the external contact point 7 from the pressure applying arm 4 is removed by elastically displacing the pressure applying arm 4 backwardly.

As means for displacing the pressure applying arm 4 forwardly and backwardly, there is a provision of a contact opening/closing member 8 disposed on an upper portion of the socket body 1. This contact opening/closing member 8 exhibits a frame-like configuration and has a central opening 9 opposing the IC receiving portion 2 from above. The IC package 6 is received in the IC receiving portion 2 through this central opening 9 for electrical connection.

For guiding the upward and downward movement, a vertical guide portion 10 of the contact opening/closing member 8 is slip fitted in a vertical guide portion 11 disposed on an outer surface of the socket body 1.

A frame wall of the contact opening/closing member 8 is provided with a cam portion 12 for opening/closing the contact 3, which contact opening/closing member 8 is disposed in such a manner as to correspond to the array of the contacts 3. By a downward operation of the opening/closing member 8, the cam portion 12 is caused to act on the pressure applying arms 4 such that the pressure applying arms 4 are elastically displaced backwardly for each array to form a contact releasing relation with the external contact point 7, and the pressure applying arms 4 are elastically displaced forwardly when the opening/closing member 8 is move upwardly, to thereby form a pressure contact relationship with the external contact point 7.

The contact opening/closing mnember 8 is moved upwardly by an upwardly biasing return spring 13, or by a forwardly displacing force generated when the pressure apply arm 4 is displaced forwardly by its restoring force.

As means for causing the cam portion 12 provided on the contact opening/closing member 8 to act on the pressure applying arm 4, a control arm 14 is integrally punched out backwardly from an area in the vicinity of an upper end of the pressure applying arm 4, and when the contact opening/closing member 8 is moved downwardly and the cam portion 12 presses a pressure receiving projection 15 projecting upwardly from an end portion of the control arm 14, the pressure receiving projection 15 is turned backwardly by guidance of the cam portion 12, to thereby displace the pressure applying arm 4 in each array backwardly against a resilient force of a first spring portion 16. When the force for pressing the contact opening/closing member 8 is removed, the opening/closing member 8 is moved upwardly through the cam portion 12 while turning the control arm 14 upwardly by a forwardly restoring force of the first spring portion 16 of the pressure applying arm 4, or the opening/closing member 8 is moved upwardly by the restoring force of the spring 13.

The pressure applying arm 4 may be elastically displaced through a motion transmitting lever made of insulative material and adapted to transform a vertical motion of the contact opening/closing member 8 into a forward and backward motion of the pressure applying arm 4.

Instead of providing the contact opening/closing member 8, the pressure applying arm 4 may be elastically displaced forwardly and backwardly by actuating a jig, which is provided on a working end of a robot, on either the pressure receiving projection 15 of the pressure applying arm 4 or the pressure receiving portion of the motion transmitting lever.

As shown in FIG. 5, as well as elsewhere, the contact 3 includes a rigid basal portion 34 extending forwardly and backwardly. The pressure applying arm 4 and the pressure receiving arm 5 extend upwardly from the basal portion 34. A male terminal 18 extends downwardly from the basal portion 34.

The basal portion 34 sits on an inner bottom surface of a contact receiving groove 19 formed in the socket body 1. The contact 3 is implanted in the socket body 1 with the male terminal 18 pressed fitted to the groove bottom wall in such a manner as to extend downwardly, and with a press-fit claw 20 formed on a press-fit portion of the basal portion of the male terminal 18 bit into an inner wall of a through hole. On the other hand, the pressure applying arm 4 and the pressure receiving arm 5 extend upwardly through the contact receiving groove 19.

The first spring portion 16 of the pressure applying arm 4 is formed by a lateral S-shaped spring portion 16' which includes a front curved portion and a rear curved portion. One end of the lateral S-shaped spring portion 16', i.e., an end portion of the rear curved portion is connected with the basal portion 34 and the other end, i.e., an end portion of the front curved portion is connected with a contact arm 35 at a forwardly inclined angle. The contact arm 35 is provided on a free end thereof with a downwardly facing contact projection 22.

The control arm 14 extends backwardly from the connecting portion between the contact arm 35 and the lateral S-shaped spring portion 16'. The control arm 14 is provided on a free end thereof with the upwardly facing pressure receiving projection 15.

The cam portion 12 of the contact opening/closing member 8 acts on the pressure receiving projection 15 to displace the pressure applying arm 4 backwardly against the resilient force of the lateral S-shaped spring portion 16'.

On the other hand, the pressure receiving arm 5 disposed forwardly of the pressure applying arm 4 includes a second spring portion 21. An upper end of the second spring portion 21 is connected with the load receiving portion 17.

The second spring portion 21 has both the function for elastically displacing the load receiving portion 17 forwardly and the function for elastically displacing the portion 17 upwardly and downwardly. The second spring portion 21 exhibits a spring configuration capable of satisfying those functions.

As shown in FIG. 5, as well as elsewhere, for example, a forwardly projecting curved spring portion 21' is provided on the basal end side. An end portion of this curved spring portion 21' is connected with an upwardly extending spring arm 21", and an end portion of this spring arm 21" is connected with the load receiving portion 17. This load receiving portion 17 has rigidity. With the contact 3 implanted in the socket body 1, an upper surface of the load receiving portion 17 forms a load receiving surface 23 which is inclined at a horizontal angle or close to a horizontal angle.

As shown by broken lines of FIG. 3C, when the IC package 6 is not present, the contact projection 22 of the pressure applying arm 4 is in contact, under pressure, with the load receiving surface 23.

As shown in FIG. 3A, by downward operation of the contact opening/closing member 8, the pressure applying arm 4 is elastically displaced backwardly and at the same time, the contact projection 22 is displaced slantwise backwardly to open the load receiving surface 23. As shown in FIGS. 9 and 10, when the load receiving surface 23 is in the open position, the IC package 6 is received in the IC receiving portion 2 and the external contact point 7 projecting sidewardly from the IC package body is placed on the load receiving surface 23 of the load receiving portion 17.

The pressure receiving arm 5 is provided on the load receiving portion with a downward movement preventive portion 24 which is capable of engaging with the socket body 1 to set the load receiving level of the load receiving portion 17.

Figure 9A:
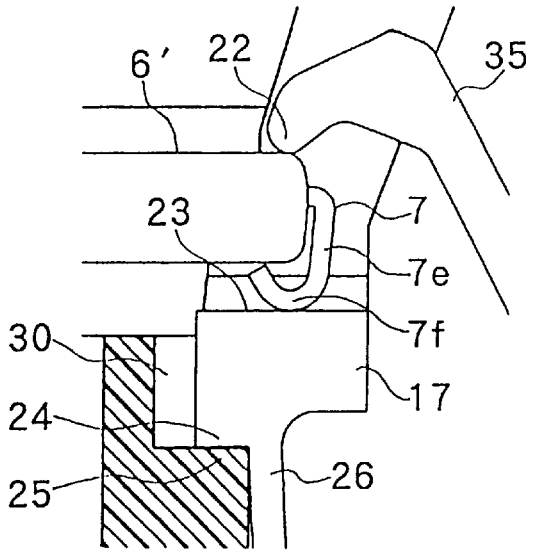
FIG. 9A is an enlarged sectional view, showing the contact being in contact, under pressure, with an upper surface of an IC package body having a J-bent type external contact point.
Figure 9B:
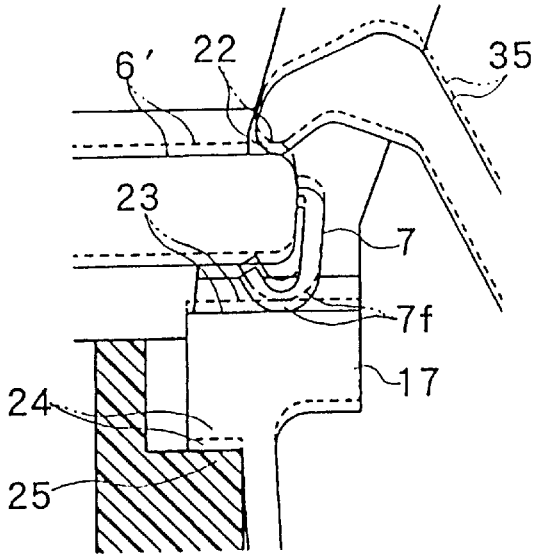
FIG. 9B is an enlarged sectional view, showing the contact being in contact, under pressure, with the J-bent type external contact when the load receiving portion of the contact of FIG. 9A is floating upwardly and in a standby position.
Figure 10A:
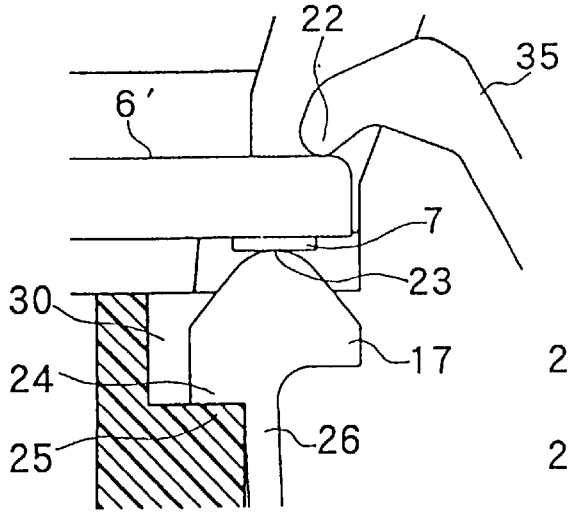
FIG. 10A is an enlarged sectional view, showing the contact being in contact, under pressure, with an upper surface of a leadless type IC package body.
Figure 10B:
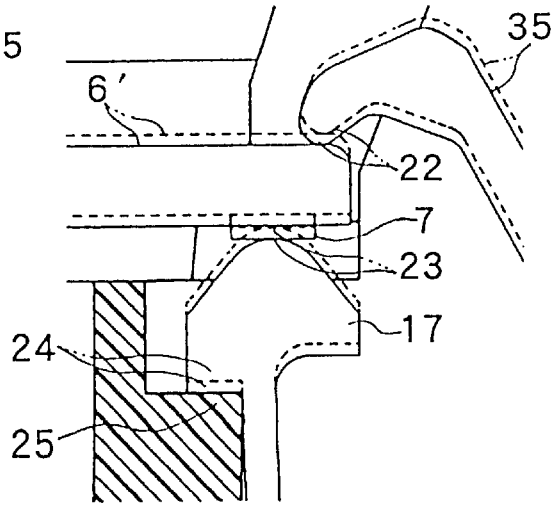
FIG. 10B is an enlarged sectional view, showing the contact being in contact, under pressure, with an external contact point of the leadless type IC package when the load receiving portion of the contact of FIG. 10A is floating upwardly and in a standby position.

As shown in FIGS. 9A and 10A, as well as elsewhere, the downward movement preventive portion 24 is normally engaged with a downward movement preventive portion 25 provided on the socket body 1 to thereby maintain the constant load receiving level of the load receiving portion 17, i.e., the constant load receiving level of the load receiving surface 23.

That is, as shown in FIGS. 9A and 10A, as well as elsewhere, the load receiving portion 17 of the pressure receiving arm 5 is pulled upwardly against the effect of the second spring portion 21 to bring the downward movement preventive portion 24 into elastic engagement with the downward movement preventive portion 25. Accordingly, when the downward movement preventive portions 24, 25 are in elastic engagement with each other, the second spring portion 21 stores the downward resilient force. By this, the load receiving portion 17 maintains the constant load receiving level with respect to the external contact point 7 of the IC package 6.

As shown by broken lines of FIGS. 9B and 10B, as well as elsewhere, the load receiving portion 17 is brought in a standby position upwardly away from the downward movement preventive portion 25. Then, the load receiving portion 17 is moved downwardly against the pressing force of the pressure applying arm 4 to bring the downward movement preventive portion 24 into engagement with the downward movement preventive portion 25, thereby to maintain the constant load receiving level of the load receiving portion 17 with respect to the external contact point 7.

The downwardly facing surface (downward movement preventive portion 24) of the load receiving portion 17 is brought into elastic engagement with the upwardly facing surface (downward movement preventive portion 25) provided on the socket body 1 against the resilient force of the second spring portion of the pressure receiving arm 5. The downward movement preventive portions 24, 25 are inclined at a horizontal angle or near to a horizontal angle.

The pressure receiving arm 5 can be elastically displaced forwardly and backwardly together with the load receiving portion 17 by the second spring portion 21. The connecting portion between the pressure receiving arm 5 and the load receiving portion 17 may be provided with a forward movement preventive portion 26 which is elastically engaged with the socket body 1 to restrict the forward movement of the load receiving portion 17 when the contact 3 is implanted in the socket body 1.

As shown in FIG. 6, the load receiving portion 17 may be provided with a backward movement preventive portion 28 which is brought into engagement with the socket body 1 to restrict the backward movement of the load receiving portion 17.

Preferably, as shown in FIGS. 3C, as well as elsewhere, the forward movement preventive portion 26 is formed by a front side surface of an upper end portion of the pressure receiving arm 5 located immediately under the load receiving portion 17, and restricts the forward movement of the load receiving portion 17 by bringing the front side surface into elastic engagement with a forward movement preventive portion 27 provided on the socket body 1.

Instead of the above construction, the forward movement of the load receiving portion 17 can be restricted by bringing the front side surface of the load receiving portion 17 into elastic engagement with the side surface of the socket body 1.

The backward movement preventive portion 28 is formed by an engagement piece 28' projecting downwardly from the downward movement preventive portion 24 formed on, for example, the downwardly facing surface of the load receiving portion 17, and this engagement piece 28' is brought into engagement with an engagement groove 29' formed in the upwardly facing surface which forms the downward movement preventive portion 25 provided on the socket body 1.

The engagement piece 28' is engaged with an inner surface of the engagement groove 29' to thereby prevent the backward movement of the load receiving portion 17. The engagement groove 29' forms the backward movement preventive portion 28 which restricts the backward movement of the load receiving arm 5 by co-acting with the engagement piece 28'.

As shown in FIGS. 9A, 9B, 10A and 10B, as well as elsewhere, when the pressure applying arm 4 is restored forwardly, the contact projection 22 is brought into contact, under pressure, with the external contact point 7 of the IC package 6 to exert a downward force thereto, so that the external contact point 7 is brought into contact, under pressure, with the load receiving surface 23 of the pressure receiving arm 5 by this downward force.

As shown by broken lines of FIGS. 3C, 4B, 5, 7A and 8A, as well as elsewhere, the contact projection 22 of the pressure applying arm 4 is in a standby position in pressure contact relationship with the upper surface of the socket body 1 and held in a so-called preloaded state. When the external contact point 7 of the IC package 6 is pinchingly held between the contact projection 22 of the pressure applying arm 4 and the load receiving surface 23 of the load receiving portion 17, a resilient force corresponding to the thickness of the external contact point 7 in addition to the preload is applied indirectly to the external contact point 7 so that the external contact point 7 is brought into contact, under pressure, with the load receiving portion 17 of the pressure receiving arm 5 by this additional resilient force.

The load receiving portion 17 of the pressure receiving arm 5 is received in a receiving groove 30 formed in the socket body 1 and prevented from a sideward displacement by a partition wall formed between adjacent receiving grooves 30, so as to be held in a corresponding position to the external contact point 7.

The receiving grooves 30 of the load receiving portion 17 and the receiving grooves 19 of the contact are arranged at mutually same pitches and communicated with each other.

As shown in FIG. 4D, as well as elsewhere, the socket body 1 has a slanted surface 31 for guiding an outer surface of the external contact point 7 on the end of the array into a correct placing position when the IC package 6 is received in the IC receiving portion 2.

The slanted surfaces 31 are provided in such a manner as to correspond to the outer surfaces of the external contact points 7 on the opposite. ends of each array of the external contact points 7 projecting from each side of the IC package 6. The outer surfaces of the external contact points 7 are slid along the slanted surfaces 31 so that the external contact points 7 are correctly placed on the load receiving surface 23 of the pressure receiving arm 5.

The IC package 6 of the first and the second embodiment has, as one example, a gull wing type external contact 7 as shown in FIG. 4A–FIG. 4C.

Specifically, this external contact point 7 includes a basal portion 7*a* slightly projecting from two or four opposing side surfaces of the IC package body 6', an intermediate portion 7*b* bent into an inverted L-shape from the basal portion 7*a*, and a distal end portion 7*c* bent into an L-shape from the intermediate portion 7*b*.

In the embodiment shown in FIG. 4A–FIG. 4C, as sell as elsewhere, the pressure applying arm 4 exerts a downward force while bringing the contact projection 22 into contact, under pressure, with an upper surface of a distal end portion 7*c* of the external contact point 7. By this downward force, the lower surface of the distal end portion 7*c* is pressed against the load receiving surface 23 of the load receiving portion 17 of the pressure receiving arm 5. This load receiving surface 23 is prevented from downward movement by the downward movement preventive portions 24, 25, and the load receiving portion 17 is brought into contact, under pressure, with the lower surface while receiving the external contact point 7 against the downward force of the pressure applying arm 4.

The contact projection 22 (as indicated by the broken lines of FIG. 4B) of the pressure applying arm 4 is brought into contact, under pressure, with the upper surface of an end edge portion of the IC package body 6' to exert a downward force thereto, so that the lower surface of the distal end portion 7*c* is pressed against the load receiving surface 23 of the load receiving portion 17.

This load receiving surface 23 is prevented from downward movement by the downward movement preventive portions 24, 25, and the load receiving portion 17 is brought into contact, under pressure, with the lower surface of the distal end portion 7C while receiving the external contact point 7 against the downward force of the pressure applying arm 4.

Figure 7B:
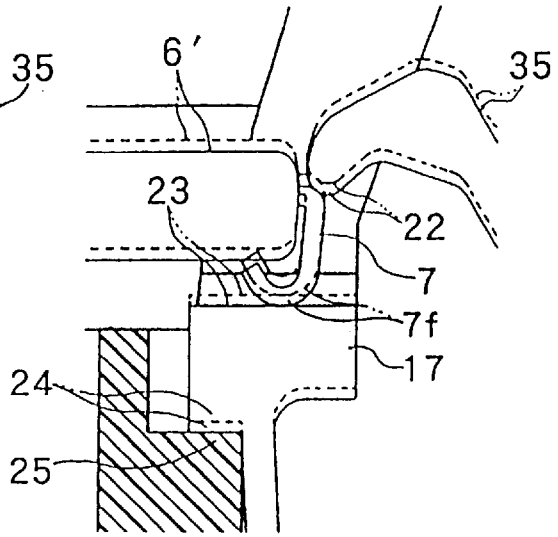
FIG. 7B is an enlarged sectional view, showing the contact being in contact, under pressure, with the J-bent type external contact point when the load receiving portion of the contact of FIG. 7A is floating upwardly and in a standby position.

As shown in FIGS. 7A and 7B, the IC package 6 of the first and the second embodiment has the external contact point 7 exhibiting a J-bent shape projecting from a side surface of the IC package body 6'. As shown in FIGS. 7A and 7B, with respect to such an IC package 6, the contact projection 22 of the pressure applying arm 4 is brought into contact, under pressure with a bent portion between the upper surface of the basal portion 7*d* of the J-bent type external contact point 7 and the intermediate portion 7*e* extending downwardly from the basal portion to exert a downward force thereto, so that the lower surface of a lower end portion 7*f* of the J-bent type external contact point 7 is pressed against the load receiving surface 23 of the load receiving portion 17 by this downward force.

The contact projection 22 of the pressure applying arm 4 of FIGS. 9A and 9B is brought into contact, under pressure, with the upper surface of the end edge portion of the IC package body 6' to exert a downward force thereto, so that the lower surface of the lower end portion 7*f* is pressed against the load receiving surface 23 of the load receiving portion 17 of the pressure receiving arm 5 by this downward force. The load receiving portion 17 having the load receiving surface 23 is prevented from a downward movement by the downward movement preventive portions 24, 25 and brought into contact, under pressure, with the lower surface of the lower end portion 7*f* while receiving the external contact point 7 against the downward force of the pressure applying arm 4.

Figure 8A:
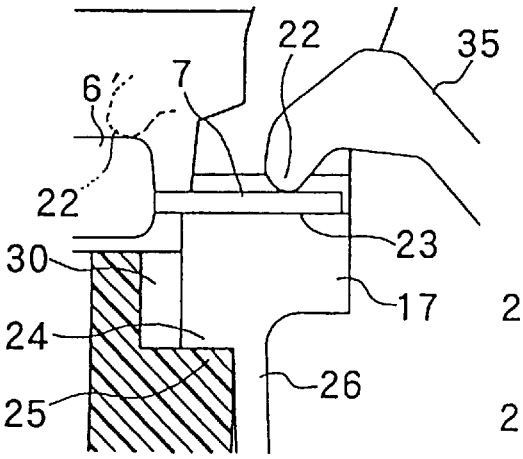
FIG. 8A is an enlarged sectional view, showing the contact of the IC package being in contact, under pressure, with a flat type external contact point of the IC package.
Figure 8B:
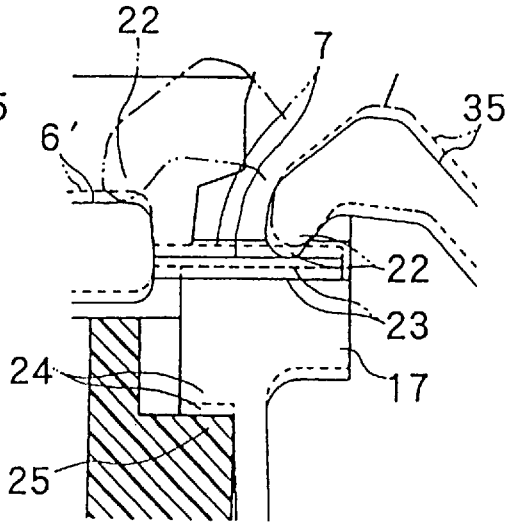
FIG. 8B is an enlarged sectional view, showing the contact being in contact, under pressure with the flat type external contact point when the load receiving portion of the contact of FIG. 8A is floating upwardly and in a standby position.

As shown in FIGS. 8A and 8B, the IC package 6 of the first and the second embodiment exhibits a flat type IC package having an external contact point 7 generally flatly projecting from the side surface of the IC package body 6'.

With respect to such an IC package 6', the contact projection 22 (as indicated by the solid line of FIGS. 8A and 8B) of the pressure applying arm 4 is brought into contact, under pressure, with the upper surface of the flat type external contact point 7 to exert a downward force thereto, so that the lower surface of the flat type contact point 7 is pressed against the load receiving surface 23 of the pressure receiving arm 5 by this downward force.

The contact projection 22 (as indicated by broken lines of FIGS. 8A and 8B) of the pressure applying arm 4 is brought into contact, under pressure, with the upper surface of the end edge portion of the IC package body 6' to exert a downward force thereto, so that the lower surface of the flat type external contact 7 is pressed against the load receiving surface 23 of the load receiving portion 17 of the pressure receiving arm 5 by this downward force. This load receiving surface 23 is prevented from a downward movement by the downward movement preventive portions 24, 25, and the load receiving portion 17 is brought into contact, under pressure, with the lower surface while receiving the external contact point 7 against the downward force of the pressure applying arm 4.

As shown in FIGS. 10A and 10B, the IC package 6' of the first and the second embodiment has an external contact point 7 formed of a conductive foil, a conductive ball, or the like, intimately contacted with the lower surface of the IC package body 6'.

With respect to such an IC package 6', the contact projection 22 (as shown in FIGS. 10A and 10B) of the pressure applying arm 4 is brought into contact, under pressure, with the upper surface of the end edge portion of the IC package body 6' to exert a downward force thereto, so that the lower surface of the external contact point 7 is pressed against the load receiving surface 23 of the pressure receiving portion 17 of the pressure receiving arm 5 by this downward force. This load receiving surface 23 is prevented from a downward movement by the downward movement preventive portions 24, 25, and the load receiving portion 17 is brought into contact, under pressure, with the lower surface while receiving the external contact point 7 against the downward force of the pressure applying arm 4.

In the IC socket according to the present invention, a reliable contact relationship with the external contact point of the IC package can be ensured by normally maintaining a constant level of contact with a pressure receiving arm to be contacted with the lower surface of the external contact point. Furthermore, since the lower limit of the pressure receiving arm is set, the pressure receiving arm can be prevented from overly moving downwardly, thus preventing the pressure receiving arm from deforming the contact point.

Obviously, numerous modifications and variations of the present invention arc possible in light of the above teachings. It is therefore to be understood that within the scope of the appended claims, the invention many be practiced otherwise than as specifically described herein.

What is claimed is:

1. An IC socket, comprising:

a socket body having a first surface; and at least one contact including a pressure applying am, a resilient pressure receiving arm, and a load receiving portion, with said load receiving portion including an engaging surface;

wherein said resilient pressure receiving arm is of a curved configuration such that when a pulling force is applied to said load receiving portion said resilient pressure receiving arm allows said load receiving portion to be resiliently displaced substantially relative to said first surface whereby said engaging surfaces said first surface, and upon release of said pulling force said resilient pressure receiving arm causes said engaging surface to be resiliently biased said first surface.

2. The IC socket according to claim 1, wherein said contact further includes a connecting portion between said resilient pressure receiving arm and said load receiving portion, wherein said connecting portion is configured to be resiliently biased against said socket body.

3. The IC socket according to claim 2, wherein said load receiving portion includes a movement preventive portion, said movement preventive portion being engageable with said socket body to restrict movement of said load receiving portion away from said socket body.

4. A contact for engaging an external contact point of an IC package, comprising:

a base;

a pressure applying arm ending from said base; and a pressure receiving arm extending from said base, wherein said pressure receiving arm includes a spring member extending across said base and curving upwardly away from said base, such that when a pulling force is applied to said spring member said spring member becomes resiliently displaced away from said base, and upon release of said pulling force said spring member returns toward said base.

5. The contact according to claim 4, wherein said base includes a main portion and a secondary portion extending from said main portion, and wherein said spring member extends generally laterally from said secondary portion across said main portion.

6. The contact according to claim 5, wherein said spring member includes a first spring portion extending across said main portion and curving upwardly therefrom, and a second spring portion extending from said first spring portion in a direction away from said main portion.

7. The contact according to claim 6, and further comprising a load receiving portion connected to a free end of said second spring portion.

8. The contact according to claim 7, wherein said load receiving portion includes a first surface facing said base and a second surface facing away from said first surface.

9. The contact according to claim 8, wherein said pressure applying arm includes an S-shaped spring portion and a contact arm, with one end of said S-shaped spring portion connected to said base and a second end of said S-shaped spring portion connected to said contact arm.

10. The contact according to claim 9, and further comprising a contact projection extending from said contact arm wherein said S-shaped spring biases said contact projection towards said second surface.

11. The contact according to claim 10, and further comprising a pressure receiving projection extending from said pressure applying arm.

12. The contact according to claim 11, and further comprising a terminal extending from said base in a direction away from said load receiving portion.

13. The contact according to claim 12, and further comprising a claw portion formed on said base intermediate said terminal and said load receiving portion.

14. The contact according to claim 8, and further comprising a movement preventing projection extending from said first surface.

15. An IC socket comprising:

a socket body; and at least one contact including (i) a base, (ii) a pressure applying arm extending from said base, and (iii) a pressure receiving arm extending from said base, wherein said pressure receiving arm includes a spring member extending across said base and curving upwardly away from said base, wherein said socket body includes a first surface, said base includes a main portion and a secondary portion extending from said main portion, with said spring member extending generally laterally from said secondary portion across said main portion, and said at least one contact further includes a load receiving portion connected to a free end of said spring member, with said load receiving portion having an engaging surface, such that when a pulling force is applied to said load receiving portion said spring member allows said load receiving portion to be resiliently displaced relative to said first surface whereby said engaging surface faces said first surface, and upon release of said pulling force said spring member causes said engaging surface to be resiliently biased against said first surface.

16. The IC socket according to claim 15, wherein said socket body further includes a second surface extending generally orthogonally to said first surface, and said spring member includes a first spring portion extending across said main portion and curving upwardly therefrom, and a second spring portion extending from said first spring portion away from said main portion, with said second spring portion having a forward surface, such that when said spring member causes said engaging surface to be resiliently biased against said first surface said front surface is also resiliently biased against said second surface.

17. The IC socket according to claim 16, wherein said load receiving portion further includes a support surfacing away from said engaging surface.

18. The IC socket according to claim 17, wherein said pressure applying arm includes an S-shaped spring portion and a contact arm, with one end of said S-shaped spring portion connected to said base and a second end of said S-shaped spring portion connected to said contact arm.

19. The IC socket according to claim 18, wherein said contact further includes a contact projection extending from said contact arm, and wherein said S-shaped spring biases said contact projection towards said support surface.

20. The IC socket according to claim 19, wherein said contact further includes a pressure receiving projection extending from said pressure applying arm.

21. The IC socket according to claim 20, wherein said contact further includes a terminal extending from said base away from said load receiving portion, and wherein said socket body includes an opening to receive said terminal.

22. The IC socket according to claim 21, wherein said contact further includes a claw portion formed on said base intermediate said terminal and said load receiving portion, and wherein said socket body includes a claw engaging portion to engage said claw portion.

23. The IC socket according to claim 16, wherein said socket body further includes a recess extending into said socket body from said first surf, and said load receiving portion further includes a projection extending from said engaging surface, such that when said spring member causes said engaging surface to be resiliently biased against said first surface said projection is received within said recess.

* * * * *